US005548916A

United States Patent [19]

Kinsel et al.

[11] Patent Number: 5,548,916

[45] Date of Patent: Aug. 27, 1996

[54] DEVICE FOR LOADING WEAPONS FITTED WITH A CYLINDER

[76] Inventors: Hagen Kinsel, Buchenhain 11; Rudolf Niemand, Buchenhain 17, both of D-34327 Körle, Germany

[21] Appl. No.: 406,886

[22] PCT Filed: Aug. 28, 1993

[86] PCT No.: PCT/DE93/00786

§ 371 Date: Mar. 22, 1995

§ 102(e) Date: Mar. 22, 1995

[87] PCT Pub. No.: WO94/12842

PCT Pub. Date: Jun. 9, 1994

[30] Foreign Application Priority Data

Nov. 24, 1992 [DE] Germany ..... 42 39 445.7

[51] Int. Cl.[6] ..... F41A 9/85

[52] U.S. Cl. ..... 42/89

[58] Field of Search ..... 42/89

[56] References Cited

U.S. PATENT DOCUMENTS

| | | | |
|---|---|---|---|
| 202,613 | 4/1878 | White | 42/89 |
| 1,228,505 | 6/1917 | Wesson | 42/89 |
| 2,448,732 | 11/1949 | Lima | 42/89 |
| 3,503,150 | 3/1970 | Brunhuber et al. | 42/89 |
| 3,541,716 | 11/1970 | Fordham et al. | 42/89 |
| 4,133,129 | 1/1979 | Jelinek et al. | 42/89 |
| 4,272,903 | 6/1981 | Griffis | 42/89 |
| 4,483,089 | 11/1984 | Johnson | 42/89 |
| 4,796,371 | 10/1989 | Daniels | 42/89 |
| 4,866,870 | 9/1989 | Johnson | 42/89 |

FOREIGN PATENT DOCUMENTS

| | | | |
|---|---|---|---|
| 2261499 | 9/1975 | France . | |
| 104615 | 9/1898 | Germany . | |
| 9215971 | 3/1993 | Germany . | |
| 387041 | 2/1933 | United Kingdom . | |
| 566757 | 1/1945 | United Kingdom | 42/89 |

*Primary Examiner*—Michael J. Carone
*Assistant Examiner*—Christopher K. Montgomery
*Attorney, Agent, or Firm*—Collard & Roe, P.C.

[57] ABSTRACT

A pressure limit valve for well tools where a valve member is moveable between a first closed portion, an open position and a second closed position. A spring for closing the valve is separated from a locking chamber which contains locking elements. The locking elements are located in a locking chamber and are held deactivated by a release sleeve which separates from the valve member in an open position. When the valve moves to the second closed position it is locked by engagement of the locking elements with a stop shoulder. In use between closely coupled inflatable packers, the valve prevents trapped pressure between the packers from affecting operation of the packer valve.

8 Claims, 6 Drawing Sheets

DEVICE FOR LOADING WEAPONS FITTED WITH A CYLINDER

BACKGROUND OF THE INVENTION

1. Field of the Invention

The invention relates to a device for loading weapons equipped with revolver cylinders, consisting of a housing with a central axis, in which several guide bores are arranged radially around the axis. Several spring-loaded thrust elements for the cartridges are guided in such bores, and with spring-loaded locking members projecting into the guide bores, such locking members being unlockable by a central unlocking device, whereby centrally with respect to the housing, provision is made for a guiding and supporting body with a central bore for the unlocking pin, said body being rigidly joined with the housing, and said unlocking pin being connected with the locking lever.

2. The Prior Art

A device for loading weapons equipped with revolver cylinders is known from U.S. patent specification 1,228,505, such device consisting of a housing with several guide bores arranged therein, in which guide bores spring-loaded thrust elements for the cartridge are guided, whereby spring-loaded locking members project into the guide bores, such locking members being unlockable by a central unlocking device. With said device, spring-loaded tongues are arranged on the unlocking device, the latter being disposed centrally relative to the housing, said tongues being designed hook-shaped on the end sides, so that such hook is capable of engaging a groove in the cartridge. When, under application of pressure to the unlocking device, the spring-loaded tongue is pressed inwardly, the cartridge is released.

With such a device, it is possible only to use cartridges having a matching design, i.e., the cartridges have to be provided with a groove within the bottom range, so that the elastic tongue is capable of engaging the cartridge. Said device is not suitable for cartridges having a protruding cartridge bottom. The protruding bottom would cause the cartridge to be disposed slanted in the guide bore, with the consequence that safe loading of the revolver is not assured.

A device for loading firearms is known also from FR-A 2261499. With this device, provision is made for locking levers supporting themselves on a pressure sleeve, and for catches for engaging the cartridge and the unlocking pin.

However, such a device is not suitable for loading all openings of the cylinder of a revolver with cartridges at the same time.

A device of the type specified above is known from U.S. Pat. No. 2,488,732. This device, however, is constructed with great expenditure, and, therefore, expensive.

SUMMARY OF THE INVENTION

Therefore, the invention is based on the problem of creating a device for loading weapons equipped with revolver cylinders, by which device it is possible to load revolver cylinders with cartridges having a protruding bottom, such device being simple and manufacturable at reasonable cost while nevertheless operating in a reliable way.

According to the invention, this is accomplished in that the locking levers supported on a pressure sleeve support themselves with their center sections and their one ends on the unlocking pin, whereby the levers have, on opposite sides, catches for engaging the cartridge on the one side, and the unlocking pin on the other side.

In this connection, the catches are arranged on both sides of the support site of the locking lever on the guiding and supporting body, so that the locking levers are capable of performing a tilting motion for the purpose of unlocking the cartridge, or during loading of the latter. As opposed to the closest state of the art according to U.S. Pat No. 2,488,732, the cartridges are guided by the pressure sleeve into the openings of the cylinder through spring force. With the state of the art, the cartridges can be moved into the openings of the cylinder only by exploiting the force of gravity.

Furthermore, the locking levers are arranged on the guiding and supporting body distributed across the circumference.

According to a special embodiment, the guiding and supporting body is a cage consisting of grooves for receiving the locking levers, such grooves being arranged on a plate distributed across the circumference, whereby the plate, on the edge side, has an inclined support surface for the ends of the locking levers, and in the center a bore for the unlocking pin.

In this way, it is accomplished that the locking levers supporting themselves in the grooves, during the reset movement of the unlocking pin, are guided along the inclined support surface until the locking lever has assumed the position required for loading with the cartridge. Said inclined support surface consequently serves for controlling the motion of the locking lever during loading and also during unloading of the cartridges from the device.

Furthermore, the ends of the locking levers are flattened in accordance with the inclined support surface of the cage, so that the locking levers rest safely against the support surface.

Moreover, opposite the inclined support surface, the locking lever has an inclined guide surface, which serves for facilitating the insertion of the cartridge.

According to a further feature of the invention, the surface of the locking lever engaging the cartridge is adapted to the cylindrical shape of the cartridge.

In order to make movement of the locking lever in a radial direction possible, the lower end of the locking lever is so positioned that it encloses an angle with the support surface of the pressure sleeve.

Furthermore, the thrust element is designed as a feed sleeve having a catch on the circumference, such catch cooperating with the one catch of the locking lever.

BRIEF DESCRIPTION OF THE DRAWINGS

An embodiment of the invention is shown by way of example in the drawing, in which.

DETAILED DESCRIPTION OF THE PREFERRED EMBODIMENT

Figure 1A:
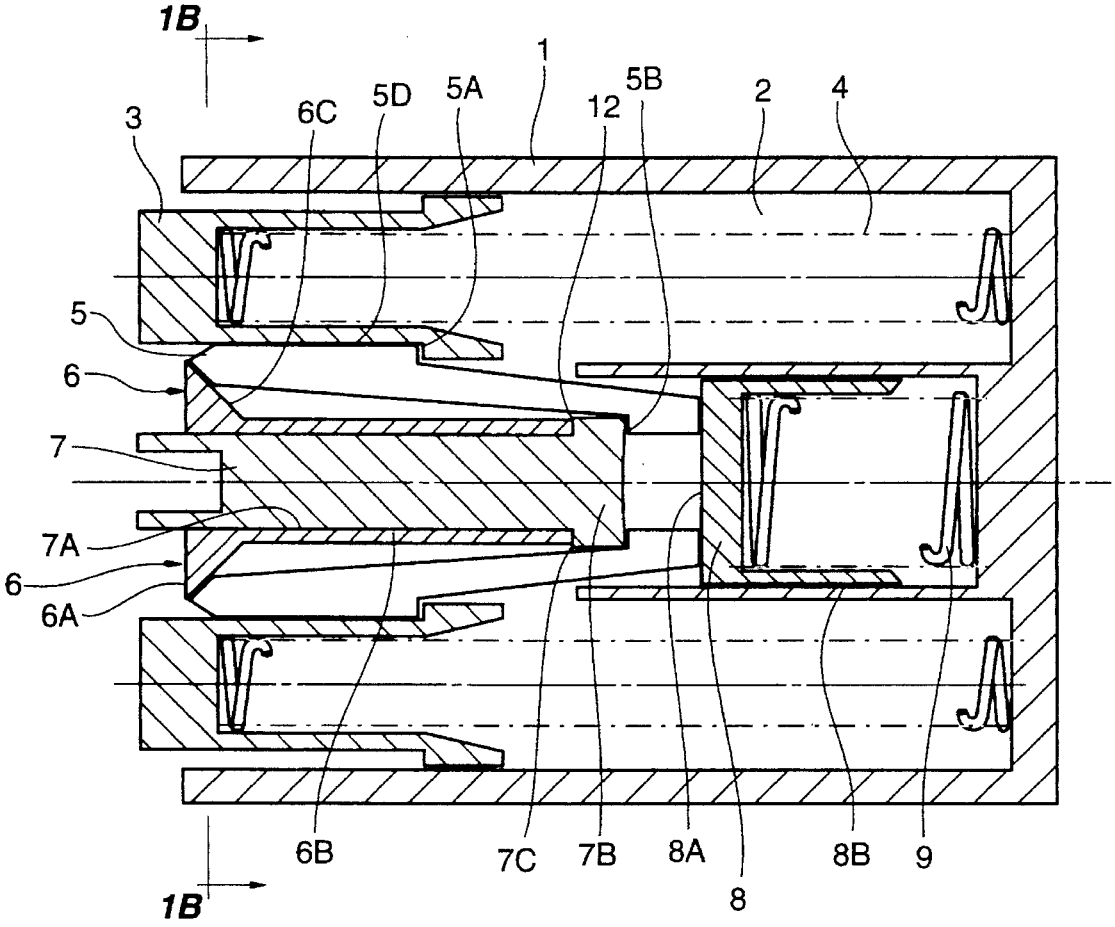
FIG. 1*a* shows a section through the device, which is shown in the position in which no cartridge is loaded.
Figure 1B:
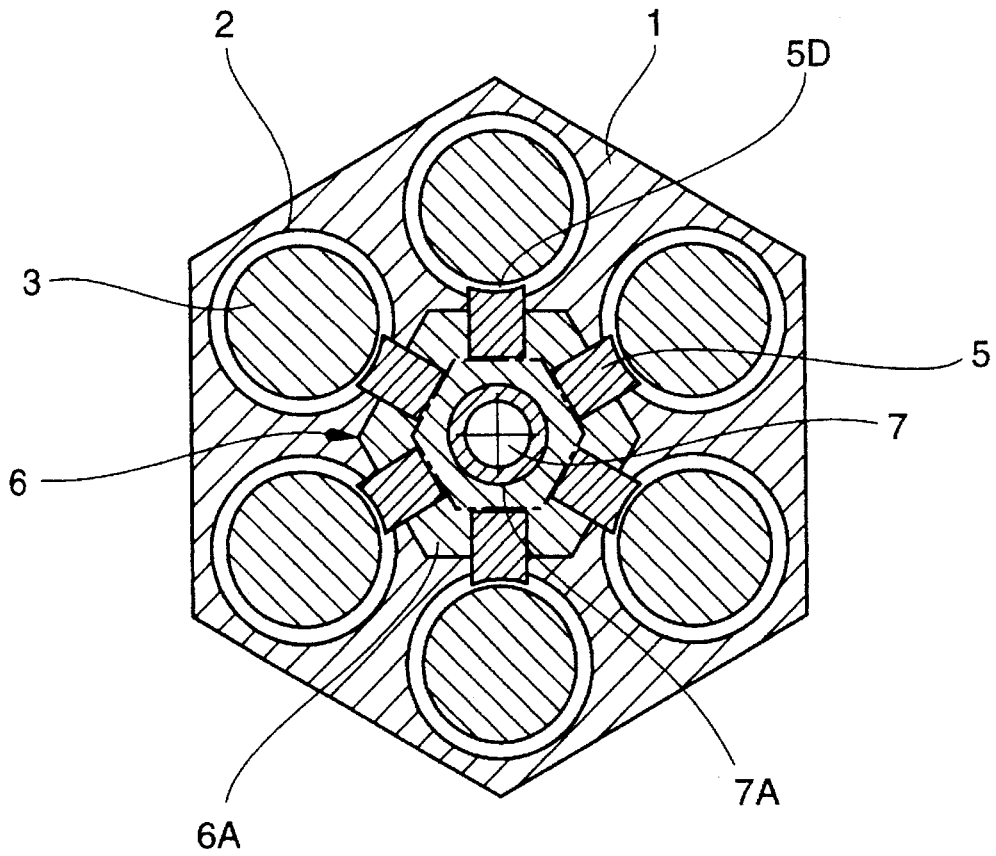
FIG. 1*b* shows a section according to line I*b*—I*b* in FIG. 1*a:*
Figure 2:
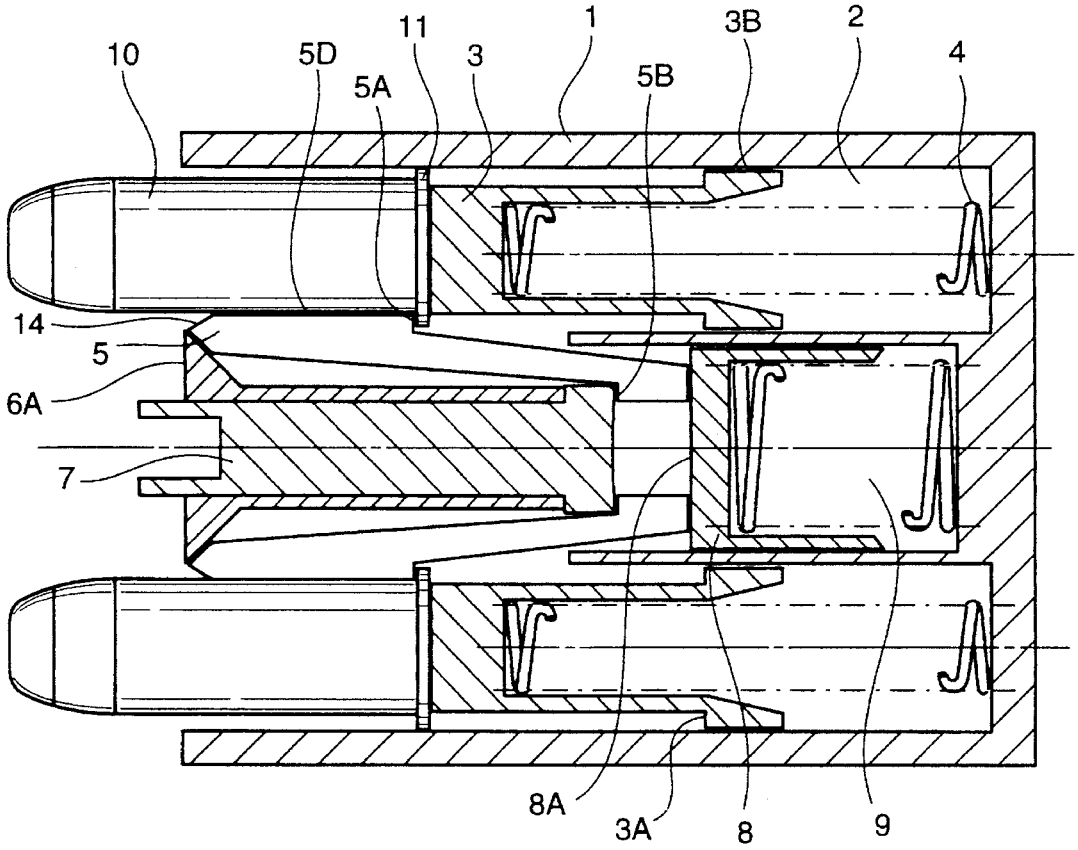
FIG. 2 shows the device with the cartridge inserted therein.

FIG. 1*a* shows that the device consists of the housing 1 with a central axis, in which several guide bores 2 are radially arranged around the central axis. Guide bores 2 have longitudinally-extending central axes arranged on a circular path. A feed sleeve 3 is guided within said guide bore 2, said sleeve being acted upon by a pressure spring 4. At the bottom end of the feed sleeve 3, the feed sleeve has a catch 3*a* (FIG. 2). The guiding and supporting body, which as a whole is denoted by 6, and which is rigidly joined with housing 1, is arranged centrally with respect to the guide bores 2.

Figure 5:
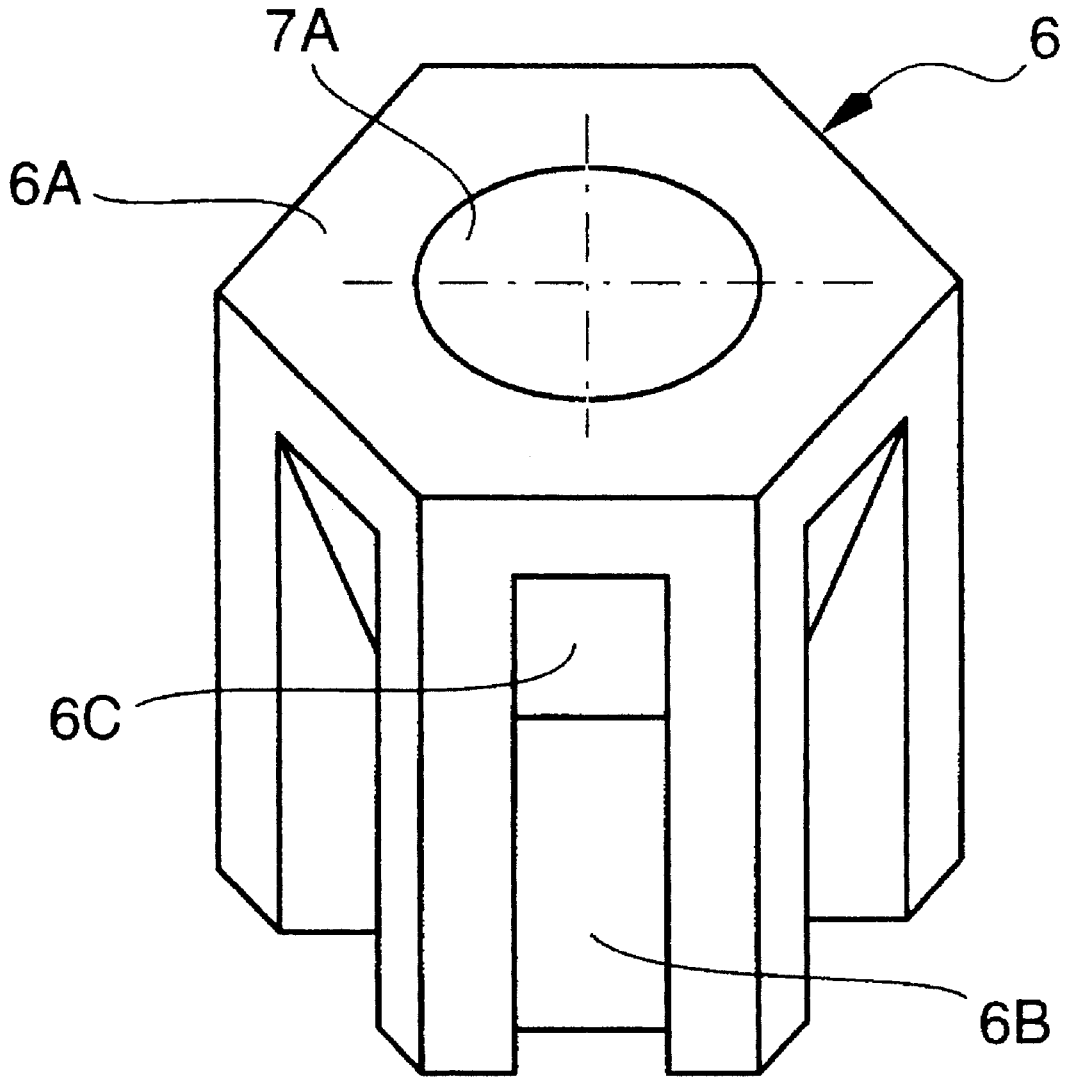
FIG. 5 shows the guiding and supporting body in a perspective view.

Said guiding and supporting body is substantially a cage in the form of a polygon, which consists of the grooves 6*b* for receiving the locking levers, such grooves being arranged on a plate 6*a* distributed across the circumference, whereby the plate 6*a* has, on the edge side, an inclined support surface 6*c* for the ends of the locking levers. The grooves 6*b* extend perpendicular to the plate 6*a* (FIG. 1*a*; FIG. 5).

Furthermore, the guiding and supporting body has a central bore 7*a*, in which the unlocking pin 7 is guided.

A pressure sleeve 8 is guided in the housing in the central housing sleeve 8*b* in the axial direction and centrally in the guiding and supporting body, said pressure sleeve being acted upon by the spring 9 (FIG. 2).

In said pressure sleeve 8, the locking levers 5 support themselves with their one ends on the support surface 8*a*. Furthermore, the locking levers are supported in their center zones in the groove, namely in the support site 12, and with their top ends on the support surface 6*c* (FIG. 1*a*).

On both sides of said support site 12, a catch 5*a* is present on the outer circumference of the locking lever, and a catch 5*b* is present on the inner circumference. The catch 5*b* is engaged by the unlocking pin 7 with its widening 7*b*. Said unlocking pin 7 at the same time supports itself with said widening on the bottom end 7*c* of the cage 6.

FIG. 2 shows that the cartridge 10 with its cartridge bottom 6 is held by the catch 5*a* of the locking lever 5.

When the revolver 13 is loaded, the unlocking pin 7 performs an axial motion, the consequence of such motion being that the locking lever 5 performs a tilting movement around it support point 12, whereby the locking lever 5 at the same time performs a slight axial motion in the groove 6*b*. During this process, the flattened surface 5*c* of the locking lever moves along the inclined support surface 6*c* of the supporting and guiding body, and is controlled by said inclined support surface (of FIG. 3).

During loading of the device with cartridges (FIG. 1*a*), the cartridge bottom 11 is first received on the feed sleeve 3 and then on the inclined guide surface 14 of the locking lever 5, with the consequence that the locking lever 5 performs a tilting motion accordingly until the cartridge bottom 11 has reached the catch 5*a* (cf FIG. 2). The cartridge is retained in the guide bore 2 by the catch 5*a*.

In order to assure safe guidance of said cartridge, the surface 5*d* of the locking lever is adapted to the cylindrical shape of the cartridge.

Figure 3:
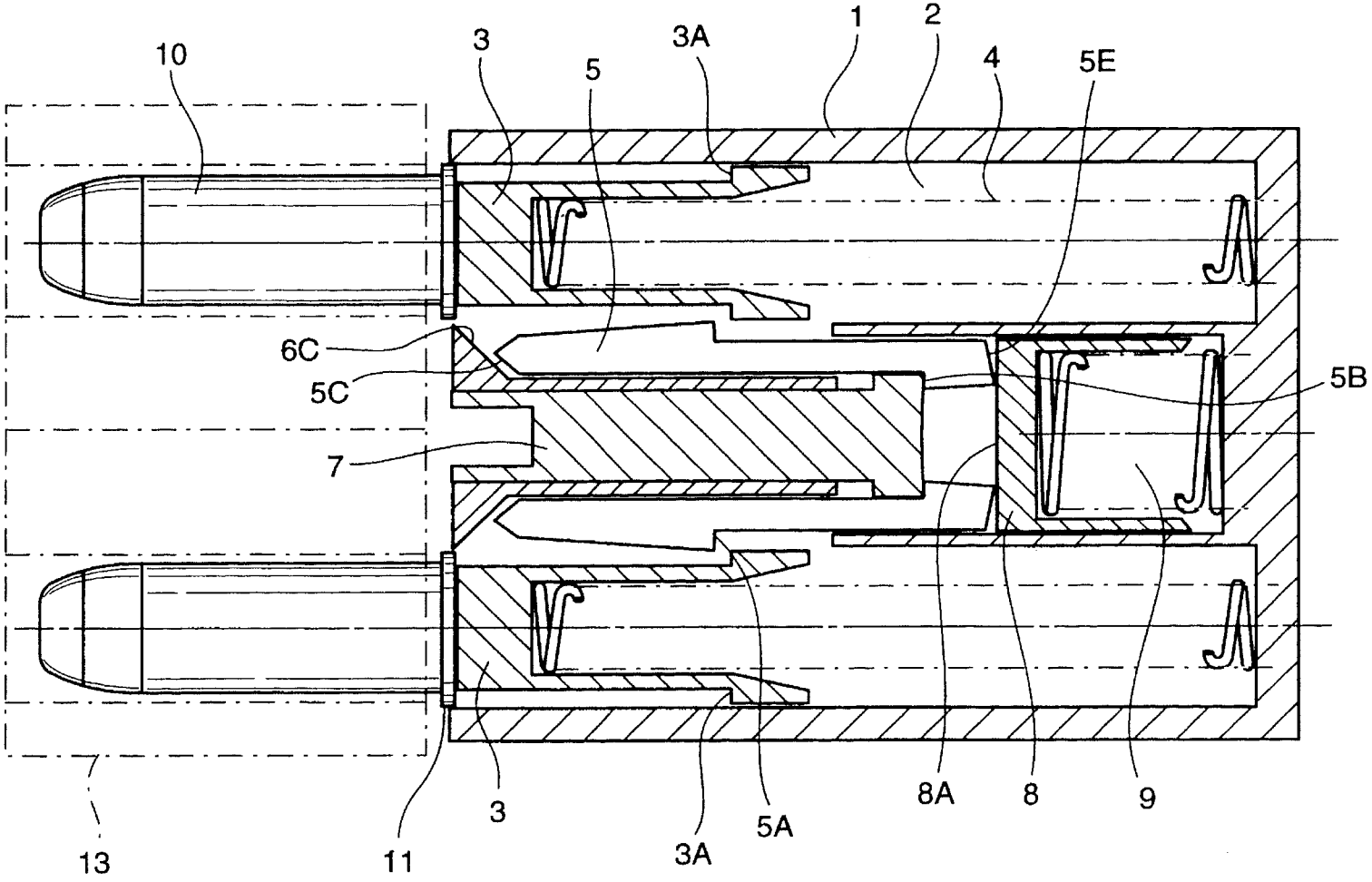
FIG. 3 shows the device in connection with the loading of the cylinder of the revolver.

In order to facilitate the tilting motion of the locking lever 5, the bottom support surface 5*e* of the locking lever is disposed at an angle relative to the support surface 8*a* of the pressure sleeve 8 (FIG. 3).

So that the feed sleeve 3 cannot slide out of the guide bore, the feed sleeve 3 has a catch 3*a*, which cooperates with the catch 5*a* of the locking lever (of FIG. 1*a*).

With the device shown, several locking levers 5 are arranged on the guiding and supporting body 6 distributed across the circumference, whereby in each case, one locking lever is provided for holding the cartridge.

At its bottom end and following the catch 3*a*, the feed sleeve 3 has a guide surface 3*b*, which rests against the inside of the guide bore 2 (FIG. 2).

Figure 4:
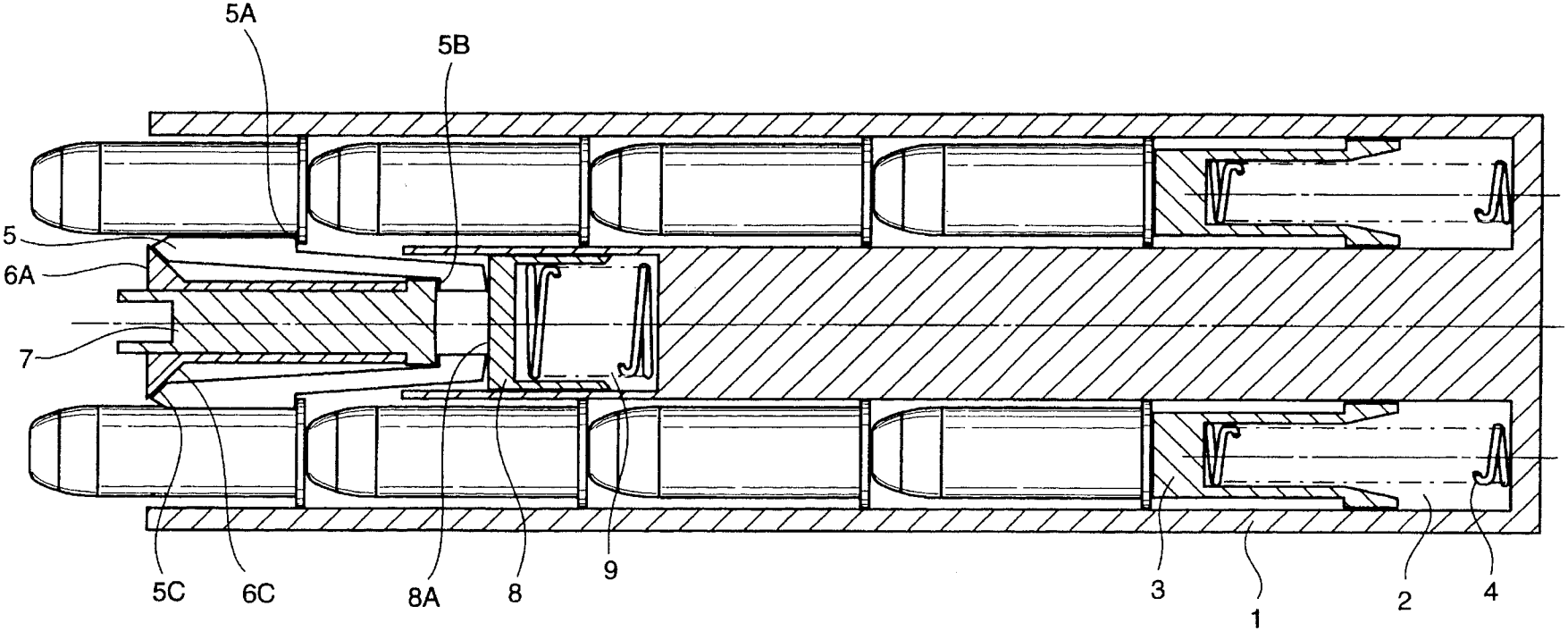
FIG. 4 shows another embodiment with several cartridges in the axial direction.

FIG. 4 shows another embodiment, which is different from the device according to FIG. 1*a* in that the guide bore 2 has a length such that several cartridges can be accommodated one after the other.

FIG. 5 shows the guiding and supporting body 6. It consists of a plate 6, which is adjoined by the grooves 6*b*, whereby the inclined support surface 6*c* is arranged at the top end of the groove 6*b*. The guide bore 7*a* for the unlocking pin 7 is provided centrally in the guiding and supporting body.

We claim:

1. A device for loading a plurality of cartridges into a revolver cylinder comprising:

a housing with a central longitudinal axis and a plurality of cartridge-receiving guide bores radially distributed around said central longitudinal axis, said plurality of guide bores having a respective plurality of longitudinally-extending central axes arranged on a circular path;

a spring-loaded thrust element guidably disposed within each guide bore;

spring-loaded locking levers projecting into each guide bore and a central unlocking device for releasably securing said locking levers, each locking lever having two ends and a center zone for support;

a guiding and supporting body centrally disposed within said housing and rigidly connected thereto, said body having a central bore;

an unlocking pin disposed within said central bore and coupled to said locking levers;

a pressure sleeve supporting one end of each of said locking levers; and catches on opposite sides of each of said locking levers, one catch of each locking lever engaging the cartridge and the other catch of each locking lever engaging the unlocking pin.

2. The device according to claim 1, wherein each end of each locking lever includes one of said catches so that one catch is located on each side of said center zone.

3. The device according to claim 1, wherein said locking levers are distributed along a circumference of said guiding and supporting body.

4. The device according to claim 1, wherein said guiding and supporting body comprises a cage with a plate having grooves distributed along a circumference of said plate, said plate including side edges with inclined support surfaces for slidingly contacting one end of said locking levers.

5. The device according to claim 1, wherein one end of each locking lever includes (i) a flattened surface for slidingly contacting said guiding and supporting body and (ii) an inclined guide surface for guiding a bottom of the cartridge into said guide bore.

6. The device according to claim 1, wherein each locking lever has an outwardly-facing surface which is arcuately shaped conforming to a cylindrical shape of the cartridges.

7. The device according to claim 1, wherein said pressure sleeve has a support surface and each locking lever has a bottom support surface which is inclined with respect to said support surface.

8. The device according to claim 1, wherein said thrust elements are feed sleeves having a catch on a circumference thereof, said catch engaging the one catch of each locking lever upon unloading of the cartridges from the device.

* * * * *